United States Patent [19]

Musso

[11] Patent Number: 4,722,624

[45] Date of Patent: Feb. 2, 1988

[54] CONTROL APPARATUS FOR PAPER PRESSURE ROLLERS OF PRINTING MACHINES

[75] Inventor: Pietro Musso, Ivrea, Italy

[73] Assignee: Ing. C. Olivetti & C., S.p.A., Ivrea, Italy

[21] Appl. No.: 880,027

[22] Filed: Jun. 30, 1986

[30] Foreign Application Priority Data

Aug. 20, 1985 [IT] Italy ..... 67730 A/85

[51] Int. Cl.[4] ..... B41J 13/036

[52] U.S. Cl. ..... 400/636.1; 400/639.1

[58] Field of Search ..... 400/636.1, 639, 639.1, 400/639.2, 636, 637, 638, 582

[56] References Cited

U.S. PATENT DOCUMENTS

| | | | |
|---|---|---|---|
| 2,356,842 | 8/1944 | Helmond | 400/639.1 X |
| 2,527,859 | 10/1950 | Veltman et al. | 400/639.1 X |
| 4,031,995 | 6/1977 | Blum et al. | 400/636.1 |
| 4,373,708 | 2/1983 | Costa | 400/686 |
| 4,486,108 | 12/1984 | Tanaka | 400/639.1 |

FOREIGN PATENT DOCUMENTS

| | | | |
|---|---|---|---|
| 162677 | 12/1981 | Japan | 400/639.1 |

OTHER PUBLICATIONS

IBM Technical Disclosure Bulletin, vol. 25, No. 11A, Apr. 1983, pp. 5598–5599, "Single-Cycle Printer Bail Closing Device", by Parks.

*Primary Examiner*—Charles A. Pearson

*Attorney, Agent, or Firm*—Banner, Birch, McKie & Beckett

[57] ABSTRACT

The control apparatus, in particular for electronic typewriters, comprises a lower guide for guiding a sheet of paper beneath a platen roller and up to a printing line of the platen roller, and a series of paper pressure rollers for guiding the sheet beyond the printing line. The pressure rollers are carried by a frame which is movable manually by a lever, a spring and lever and a pin and slot coupling to move the pressure rollers away from the platen roller and to activate a switch to initiate motor drive of the platen roller. The frame further couples a cyclic actuating mechanism to a drive pinion element of the platen roller. When the plate rotates, this mechanism acts on the frame so as to effect automatic closure of the pressure rollers, such as to permit engagement of the pressure rollers with the upper edge of the paper and subsequent printing in a region of the sheet adjacent to its top edge.

6 Claims, 6 Drawing Figures

CONTROL APPARATUS FOR PAPER PRESSURE ROLLERS OF PRINTING MACHINES

BACKGROUND OF THE INVENTION

The present invention relates to a control apparatus for paper pressure rollers of a printing machine, in particular for electronic typewriters, having a paper-carrying platen roller, a lower conveyor for guiding a sheet of paper towards the printing line and a series of paper pressure rollers for guiding the sheet beyond the printing line.

In an electronic typewriter of known type, for the purposes of introducing a sheet of paper, the operator manually positions the pressure rollers at locations which are spaced from the platen roller, introduces the sheet of paper and activates a specific command for introducing the sheet of paper. That command is recognized by the electronic control unit of the machine and it starts a program which provides for rotary movement of the platen roller for a number of steps such as to move the upper end of the sheet of paper beyond the closure position of the pressure rollers. At that point, the operator is required manually to return the pressure rollers into position against the platen roller for correct positioning of the sheet of paper prior to typing. This involves the performance of a further manual operation, besides the operation of introducing the paper.

SUMMARY OF THE INVENTION

The object of the present invention is to provide a control apparatus for automatic movement of the paper pressure rollers, which is simple, reliable, of moderate cost and very easy to use.

This object is met by the control apparatus according to the invention, which comprises a cyclic actuating mechanism which effects automatic closure of the pressure rollers such as to permit engagement of the pressure rollers with the upper edge of the paper and subsequent printing in a region of the sheet adjacent to its top edge

BRIEF DESCRIPTION OF THE DRAWING

A preferred embodiment is set forth in the following description which is given by way of non-limiting example, and with reference to the accompanying drawing in which.

DESCRIPTION OF THE PREFERRED EMBODIMENTS

Figure 1:
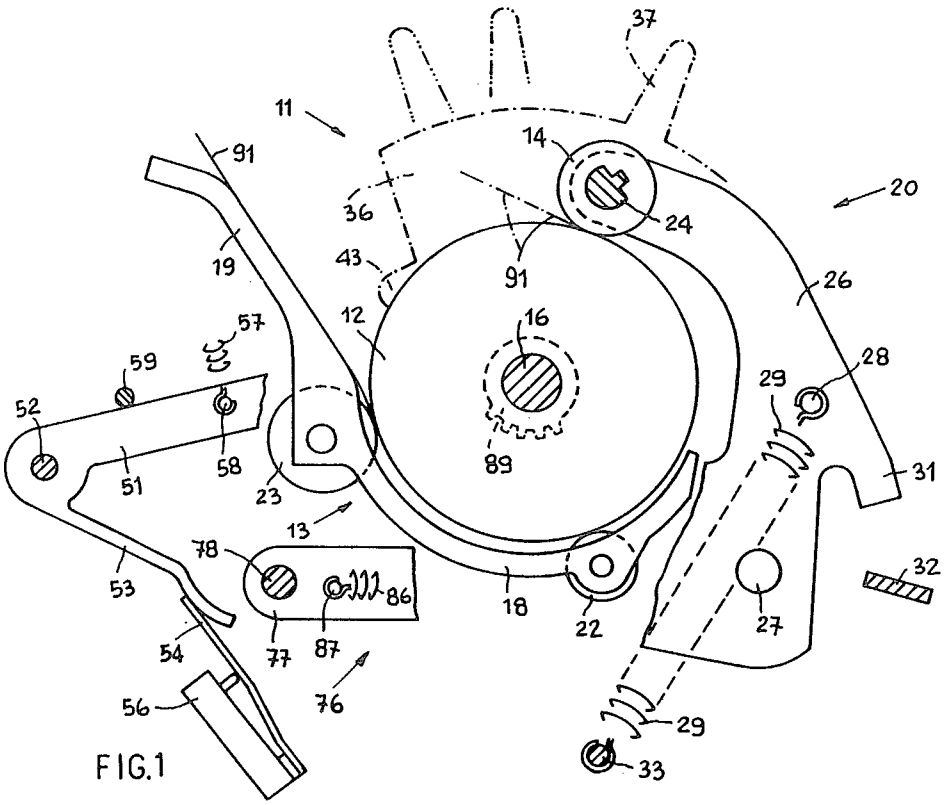
FIG. 1 shows a longitudinal view of part of an electronically controlled typewriter to which the control apparatus according to the invention is fitted.

The control apparatus for paper pressure rollers according to the invention can be fitted to typewriters, book-keeping machines, terminals or other similar printing machines. In the embodiment described hereinafter, the control apparatus which is generally indicated by reference numeral 11 in FIG. 1 is fitted to a typewriter of electronic type having a conventional platen roller 12, a lower paper pressure arrangement 13 and upper paper pressure rollers 14.

Figure 6:
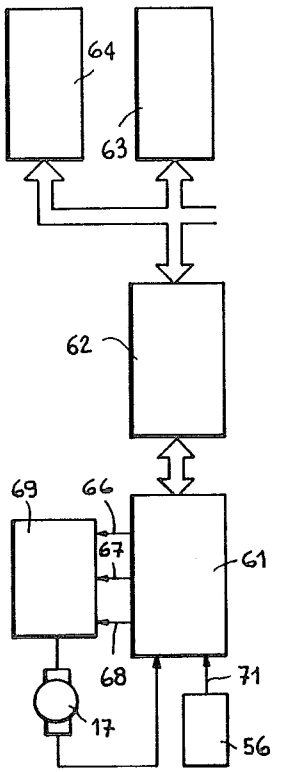
FIG. 6 shows a logic block circuit diagram of a control and actuating unit of the machine shown in FIG. 1.

The platen roller 12 is rotatable with a spindle 16 by means of an electric motor 17 (see FIG. 6) of a line spacing arrangement which is not shown in the drawings but which is substantially similar to that described in published EPO patent application No. 0143522.

The lower paper pressure arrangement 13 (see FIG. 1) comprises a lower guide 18, an inclined wall portion 19, a series of front paper pressure rollers 22 and a series of rear paper pressure rollers 23. The lower pressure arrangement 13 is also substantially similar to that described in published EPO patent application No. 0118318.

The upper paper pressure rollers 14 are carried by a frame 20 provided with a bar 24 that is parallel to the roller 12, and two arms formed by two paper pressure levers 26, only one of which is shown in the drawing. The rollers 14 are mounted slidably and rotatably on the bar 24 and each pressure lever 26 is pivoted on a spindle 27 and comprises a pin 28 capable of co-operating with a spring 29 and a lug 31 capable of co-operating with a fixed abutment 32. Each spring 29 is fitted between the pin 28 on the lever 26 and a fixed pin 33 for defining two stable positions for the frame 20. In a closure position of the rollers 14 (see FIG. 1), the frame 20 is held rotated stably in an anti-clockwise direction, with the upper paper pressure rollers 14 against the outside surface of the platen roller 12. In an open position (see FIG. 3), the frame 20 is held rotated in a clockwise direction with the lugs 31 on the levers 26 bearing against the fixed abutments 32.

The control apparatus 11 (see FIG. 2) comprises a lever 36 which is rotatable on the spindle 16 of the platen roller 12, having a gripping portion 37 for rotating the lever 36 in the clockwise and anti-clockwise directions. The lever 36 carries a pin 38 co-operable with a spring 39, a lug 41 co-operable with a shoulder 42 and a projection 43 co-operable with a lug 44. The spring 39 is fitted between the pin 38 on the lever 36 and a lug 46 on a positioning lever 47 for holding the lever 36 in a position in which it bears with the lug 41 against the shoulder 42 of the positioning lever 47. The lever 47 is rotatable about the spindle 16 of the platen roller 12 and comprises a pin 48 housed in and engaged with a slot 49 in the paper pressure lever 26 shown in the drawing.

The spring 39 defines an elastic connection between the levers 36 and 47. The spring 39 holds the levers 36 and 47 in mutual contact with each other, by means of the lug 41 and the shoulder 42, in the two stable positions of the paper pressure levers 26. By means of the elastic coupling between the levers 36 and 47 and the pin-and-slot connection 48,49 between the lever 47 and the lever 26, the pressure rollers 14 (see FIG. 1) can be moved manually by means of the gripping portion 37 from the first closure position in which they are stopped in contact against the outside surface of the platen roller 12, to the second open position in which the lug 31 on the lever 26 bears against the fixed abutment 32 (see FIG. 3), and vice-versa, as will be described hereinafter. For that purpose, the tension of the spring 39 is greater than the resistance created by the spring 29 during the movement of the lever 26, and there is thus no relative movement as between the levers 36 and 47 during the manual movement thereof.

The lever 36 (see FIG. 2) with the projection 43 can co-operate, in an over-travel position as described hereinafter, with the lug 44 of a switch control lever 51. The lever 51 is rotatable on a spindle 52 and comprises an arm 53 co-operable with a blade member 54 of a switch 56. A spring 57 which is fitted to a pin 58 on the lever 51 tends to rotate the lever 51 in the anticlockwise direction to hold it in an abutting condition against a fixed abutment 59, holding the switch 56 open.

The switch 56 (see FIG. 6) is connected by way of a line 71 to an input port of an input-output unit 61 controlled by a central unit 62 which in turn is connected to memories 63 and to a keyboard 64. The input-output unit 61, in response to closure of the switch 56, activates a program for introducing a sheet of paper, which provides for a predetermined rotary movement of the electric motor 17. That is effected in known fashion by means of three lines 66, 67 and 68 and an amplifier 69.

The control apparatus 11 of the invention comprises a drive element of the platen roller 12 (see FIG. 2) which is formed by a pinion 89 and a cyclic actuating mechanism 76. The mechanism 76 comprises an oscillating or return lever 77 which is rotatable on a spindle or shaft 78 and which has a pin 79 which is housed in and always engaged with a slot 81 in the paper pressure lever 26. The mechanism 76 further comprises a toothed wheel or eccentric gear 82 having a sleeve 83 which is eccentric with respect to the axis of the gear 82 and on which a flange 84 is fixed. The eccentric gear 82 with the flange 84 is rotatable by means of the eccentric sleeve 83 on the return lever 77 in the vicinity of the pinion 89. A spring 86 which is fitted between a pin 87 on the lever 77 and a pin 88 on the flange 84 holds the eccentric gear 82 in a rest position as shown in FIG. 2, in which the gear 82 is in the position of being spaced at the greatest distance from the pinion 89.

Figure 3:
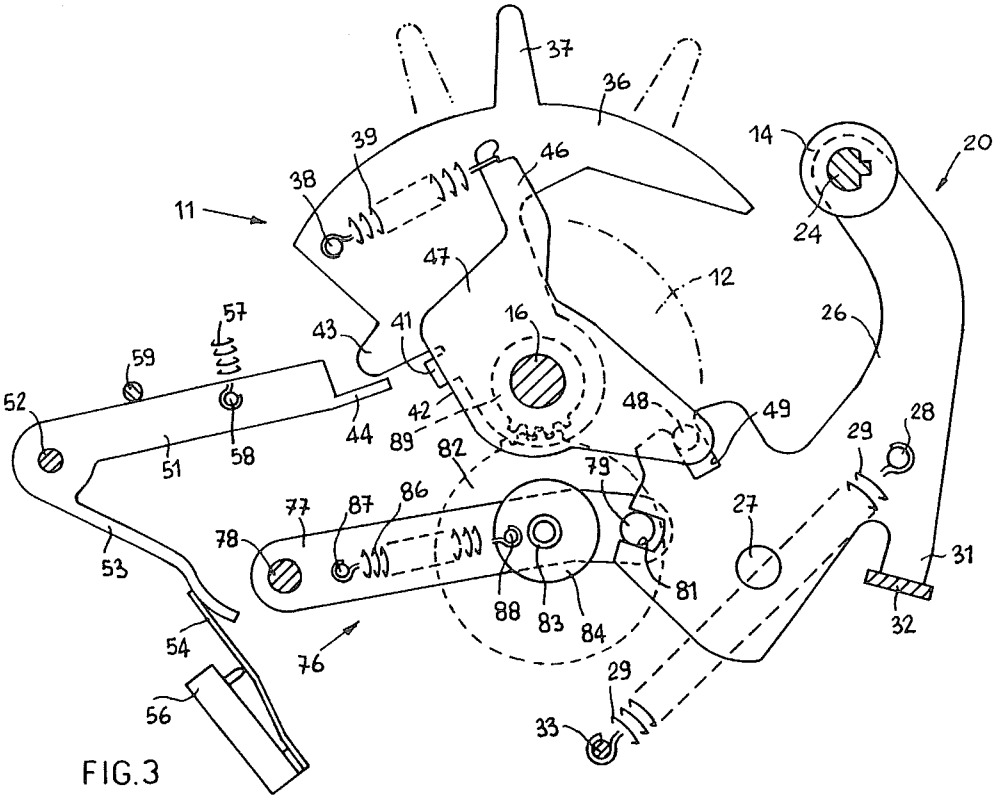
FIG. 3 is a longitudinal view of part of the apparatus shown in FIG. 2, in an operating position.

By means of the coupling involving the pin 79 and the slot 81, between the lever 26 and the lever 77, the eccentric gear 82 can be brought into engagement with the pinion 89 (see FIG. 3) when the lever 26 is in the open position of the rollers 14 as shown in FIG. 3. Under those conditions, the mechanism 76 is coupled to the drive element 89 of the platen roller 12.

Figure 2:
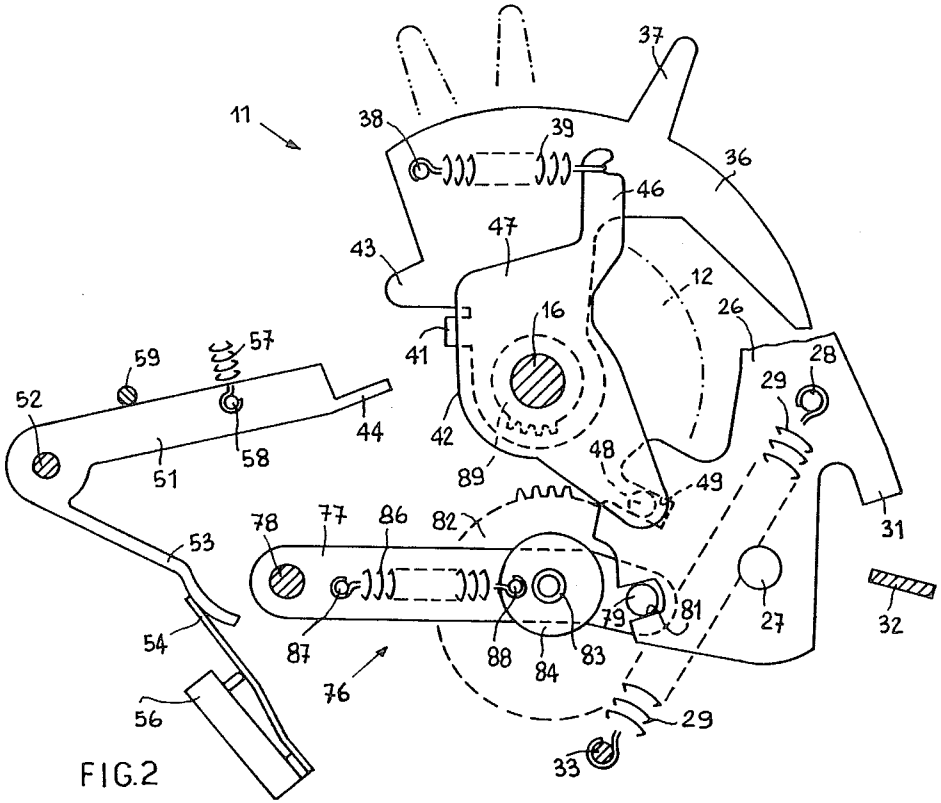
FIG. 2 is a longitudinal view of part of the apparatus shown in FIG. 1.

As described hereinbefore, two stable positions of the levers 36 and 47 which are shown respectively in FIG. 2 and FIG. 3 correspond to the respectively closed and open positions of the pressure rollers 14, as determined by the tension of the spring 29 and the conditions of abutment of the pressure rollers 14 against the outside surface of the platen roller 12 (see FIG. 1) or the condition of abutment of the lever 26 against the fixed abutment 32 (see FIG. 3), respectively.

The mode of operation of the control device 11 as described hereinbefore is as follows:

In order to introduce a sheet of paper, starting from the conditions shown in FIGS. 1 and 2 in which the upper pressure rollers 14 are in a condition of bearing against the outside surface of the platen roller 12 and the cyclic actuating mechanism 76 is in a rest position and uncoupled from the drive element 89, the operator, by means of the gripping portion 37, first rotates the lever 36 in the anti-clockwise direction. By means of the levers 36 and 47 and the connection provided by the pin 48 and the slot 49, rotary movement of the lever 47 causes rotary movement of the levers 26 in the clockwise direction and causes the paper pressure rollers 14 to move away from the platen roller 12 against the force of the respective springs 29 until the levers 26 reach an unstable position with the springs 29 at the dead centre point. When they have moved beyond that point, the springs 29 assist with the rotary movement of the levers 26 until they reach the position shown in FIG. 3 in which the lugs 31 bear against the respective fixed abutments 32. At the same time as the rotary movement of the lever 26 in the drawings, the connection comprising the pin 79 and the slot 81 causes the oscillating lever 77 to rotate in an anti-clockwise direction until the eccentric gear 82 is brought into engagement and meshes with the pinion 89 which is fixed with respect to the platen roller 12. In that condition, the levers 36, 47 and 26 are in the second position with the pressure rollers 14 spaced away from the platen roller 12 and the projection 43 on the lever 36 is close to but does not co-operate with the switch control lever 51, as shown in FIG. 3.

Figure 4:
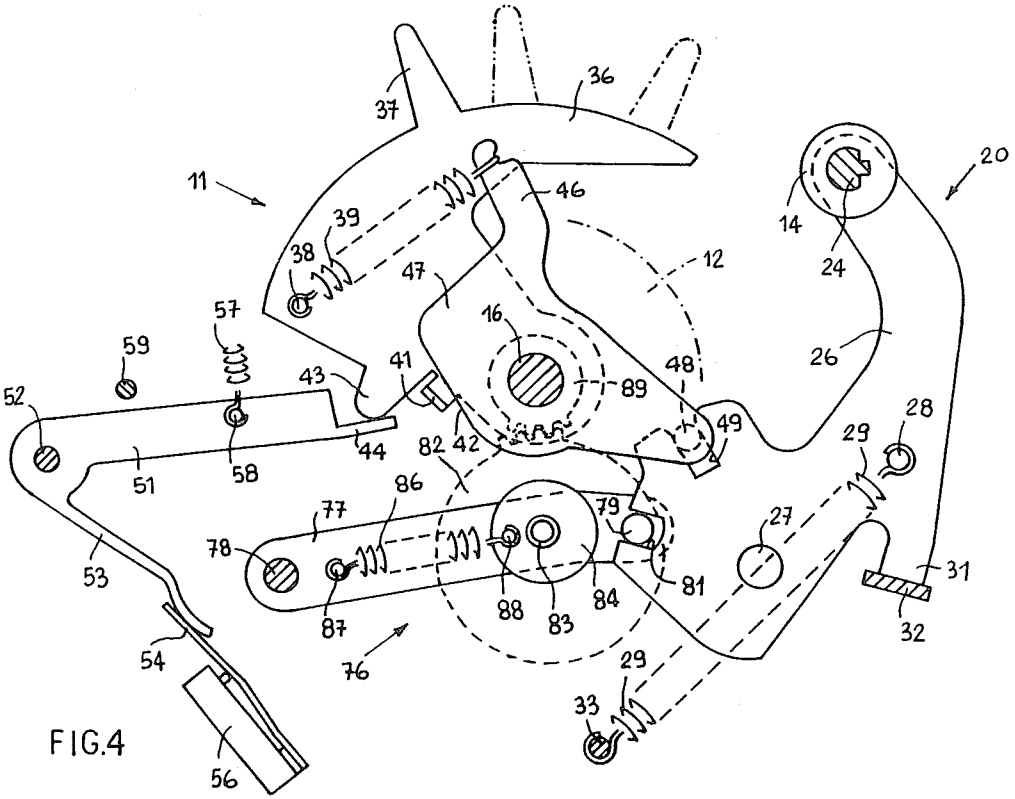
FIG. 4 is a longitudinal view of part of the apparatus shown in FIG. 2, in a subsequent operating position.

At that point, the operator introduces a sheet of paper or document 91 (see FIG. 1) between the wall portion 19 of the lower pressure arrangement 13 and the platen roller 12 and then by means of the gripping portion 37 moves the lever 36 in an anti-clockwise direction. Since, as already described above, the lever 26 (see FIG. 4) is in an arrested condition with the lug 31 bearing against the fixed abutment 32 and, by means of the connections comprising the pins 48, 79 and the respective slots 49 and 81, the lever 47 and the oscillating lever 77 also cannot rotate, all that occurs is rotary movement of the lever 36 against the force of the spring 39 providing the elastic connection between the two levers 36 and 47 and disengagement of the lug 41 from the shoulder 42. During that rotary movement of the lever 36 into an unstable position and thus into an overtravel condition, the projection 43 engages the lug 44 and rotates the switch control lever 51 in the clockwise direction against the force of the spring 57. As it rotates, the arm 53 of the lever 51 moves the blade member 54 and closes the switch 56.

Figure 5:
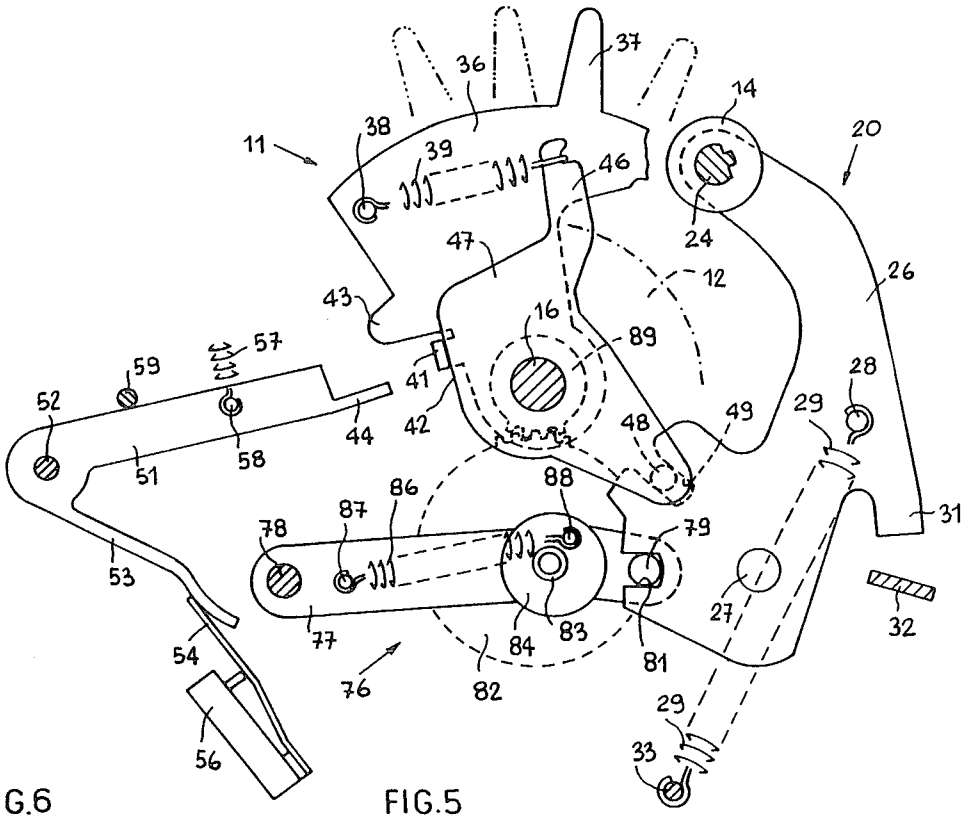
FIG. 5 is a longitudinal view of part of the apparatus shown in FIG. 2, in a further operating position.

By means of the line 71 (see FIG. 6), the switch 56 now signals closure thereof to the central unit 62, activating the program for introducing the sheet of paper 91. For that purpose, the input-output unit 61 passes commands to the motor 17 to cause the platen roller 12 (FIG. 1) to rotate in the anti-clockwise direction by a predetermined number of steps such as to position the upper edge of the sheet of paper 91 beyond the point at which the pressure rollers 14 will come into contact with the outside surface of the platen roller 12. As soon as the operator releases the gripping portion 37 (see FIG. 5), the spring 39 returns the lever 36 to the position in which it is arrested with the lug 41 against the shoulder 42 and the spring 57 returns the lever 51 to the rest condition, in which it bears against the fixed abutment 59.

In the condition as defined hereinbefore, rotary movement of the platen roller 12 causes activation of the mechanism 76. In fact the rotary movement of the pinion 89 causes rotary movement of the eccentric gear 82 in a clockwise direction against the force of the spring 86. During its rotary movement, the eccentric gear 82, by virtue of its eccentricity, causes the lever 77 on which it is mounted to move downwardly and to oscillate in a clockwise direction, passing through the condition shown in FIG. 5. The lever 77, being connected with the pin 79 to the slot 81 in the paper pressure lever 26 in the drawings, in turn rotates the frame 20 in the anti-clockwise direction against the force of the springs 29, towards the closure position of the pressure rollers 14. As already described above, as soon as the springs 29 have moved beyond their dead centre point, they assist with further rotary movement of the frame 20 until the pressure rollers 14 (FIG. 1) carry the upper edge of the sheet of paper 91 which clings to the platen roller 12 and they are arrested against the outside surface of the platen roller 12.

During the rotary movement of the frame 20 beyond the dead point of the springs 29, the lever 26 shown in the drawings, by means of the connections comprising the pins 79 (FIG. 2), 48 and the slots 81, 49, disengages the eccentric gear 82 of the mechanism 76 from the pinion 89 and returns the levers 47 and 36 to their initial rest position. When the eccentric gear 82 ceases to be engaged with the pinion 89, it is returned rapidly to the rest position by its spring 86, as shown in FIG. 2, completing the operating cycle of the cyclic actuating mechanism 76. At the end of the cycle of the mechanism 76, the sheet of paper 91 clings to the roller 12 and is in the position which permits printing on a region of the sheet of paper which is close to the upper edge thereof.

The transmission ratio between the pinion 89 and the eccentric gear 82 is such as to cause automatic closure of the pressure rollers 14 to occur with certainty only when the upper edge of the sheet 91 is in the region of engagement between the pressure rollers 14 and the platen roller 12.

The introduction program which is stored in the memories 63 (see FIG. 6) and processed by the central unit 62 causes the motor 17 to rotate through an angular distance such as to position the upper edge of the sheet 91 in a position corresponding with the region of engagement between the pressure rollers 14 and the platen roller 12. A further rotary movement of the platen roller 12 then further moves the sheet upwardly but has no effect on the apparatus 11. On the other hand automatic closure of the pressure rollers occurs even in the case where the sheet 91 is advanced by means of a manual rotary movement of the platen roller 12 through an amount equal or greater than the rotation of the platen 12 required for the disengaging of the eccentric gear 82

The above-described control apparatus 11 is particularly suitable for fitting to those machines in which the printing unit is carried by a movable carriage and is mounted very closely to the platen roller 12. That is the case where the printing unit is formed by a character-carrying "daisy wheel" having flexible spokes, as described in published U.K. patent application No. 2030332, or when the printing unit is of the needle type.

It will be appreciated that the control apparatus 11 as described hereinbefore may be the subject of various modifications, improvements and addition of parts without departing from the scope of the present invention. In particular the cyclic actuating mechanism 76 may provide for different types of coupling to the platen roller 12 such as cyclic coupling means, or it may provide for cam-type mechanisms of various kinds for coupling to the platen roller 12 or for connection to the support of the paper pressure rollers 14.

What is claimed is:

1. A control apparatus for paper pressure rollers of a printing machine having a platen roller, which is rotatable for movement of a sheet of paper, a support member for the pressure rollers which is actuable for movements of the pressure rollers with respect to the platen roller, a drive element driven by the platen roller, a cyclic actuating mechanism for actuation of the support member of the pressure rollers, a coupling element capable of coupling the cyclic actuating mechanism to the drive element for moving the support member of the pressure rollers in response to the rotary movement of the platen roller, fixed abutments and bistable spring means, wherein the support member comprises a bar and two arms, in which the paper pressure rollers are rotatable and slidable on the bar, in which the arms are movable from a first position in which the paper pressure rollers are in contact with the surface of the platen roller to a second position in which the paper pressure rollers are spaced from the platen roller to permit the sheet of paper to be introduced, and in which the movable arms are arrested against the fixed abutments and the bistable spring means hold the movable arms in the first and second positions, and wherein the coupling element is actuated by one of the movable arms when the movable arms are moved into the second position, further comprising a mechanism for motor drive of the platen roller, program means for controlling the motor drive mechanism for rotating the platen roller by an amount such as to move the sheet from a position of introduction to a reference position in which the upper edge of the sheet is above a printing line of the machine, and a control member which is movable manually from a rest position to an operative position and to an overtravel position, and a connecting element making a connection between the control member and the support member of the pressure rollers such that the closed position of the pressure rollers corresponds to the rest position of the control member and the open position of the pressure rollers corresponds to the working and overtravel positions of the control member, and wherein the control member, in its overtravel position, activates the program means in such a way that the motor drive mechanism moves the sheet to its reference position, wherein the manually movable control member comprises a pair of levers which are rotatable on the axis of the platen roller and are connected together by an elastic coupling, in which the first lever has a gripping portion and is movable between the rest position, the operative position and the overtravel position and the second lever is connected to one of the movable arms, in which the first lever is capable of operating the movable arms for movement thereof, by way of the second lever and the elastic coupling between the working positions and the operative position, a switch, and in which the first lever is capable of acting on said switch which is connected to the program means to activate the rotary movement of the platen roller when the movable arms are in the second position and the first lever is moved into its over-travel position.

2. Apparatus according to claim 1, wherein the drive element comprises a drive gear synchronous with the platen roller and the cyclic actuating mechanims comprises an oscillating lever and an eccentric rotatable driven gear, on the oscillating lever, and which is adjacent to the drive gear, and the coupling element is actuatable to move the oscillating lever from a first position in which the driven gear is disengaged from the drive gear to a second position in which the driven gear is engaged with the drive gear and wherein the coupling element connects the oscillating lever to one of the movable arms in such a way that the driven gear may be engaged with the drive gear when the movable arms are in their second position and in such a way that the oscillating lever can transmit the motion to the movable arms for movement of the paper pressure rollers towards the closed position wherein the eccentric rotary movement of the driven gear by means of the platen roller causes oscillation of the oscillation lever and moves the movable arms until the bistable spring means , having moved beyond their dead point, assist with this movement, automatically positioning the movable arms from the second to the first position, and disengage the driven gear from the drive gear.

3. A control apparatus according to claim 2 wherein the coupling element between the oscillating lever and the movable arm is of the pin-and-slot type and wherein the driven gear and the drive gear have a transmission ratio such as to cause automatic closure of the paper pressure rollers when the upper edge of the sheet is certainly beyond the region of engagement between the paper pressure rollers and the surface of the platen roller.

4. A control apparatus for paper pressure rollers of a printing machine having a platen roller, which is rotatable for movement of the paper, a support member for the pressure rollers which is actuable for movements of the pressure rollers with respect to the platen roller, a drive element driven by the platen roller, a cyclic actuating mechanism for actuation of the support member of the pressure rollers, a coupling element capable of coupling the cyclic actuating mechanism to the drive element for moving the support member of the pressure rollers in response to the rotary movement of the platen roller, fixed abutments, and bistable spring means, and wherein the support member comprises a frame having a bar and two arms, in which the paper pressure rollers are rotatable and slidable on the bar, in which the two arms are movable from a first position in which the paper pressure rollers are in contact with the surface of the platen roller to a second position in which the paper pressure rollers are spaced from the platen roller to permit the sheet of paper to be introduced, and in which the movable arms are arrested against the fixed abutments and the bistable spring means hold the movable arms in the first and second positions, wherein the coupling element is capable of being actuated by one of the movable arms when the movable arms are moved into the second position, wherein the drive element comprises a drive gear synchronous with the platen roller and the cyclic actuating mechanism comprises an oscillating lever and an eccentric rotatable driven gear on the oscillating lever, and which is adjacent to the drive gear, and the coupling element is actuatable to move the oscillating lever from a first position in which the driven gear is disengaged from the drive gear to a second position in which the driven gear is engaged with the drive gear, wherein the coupling element connects the oscillating lever to one of the movable arms in such a way that the driven gear may be engaged with the drive gear when the movable arms are in their second position and in such a way that the oscillating lever can transmit the oscillating motion to the movable arms for movement of the paper pressure rollers towards the closed position, further comprising a control member which is movable manually from a rest position to an operative position, a drive mechanism actuatable for the rotary movement of said platen, a switch member operable for actuating said drive mechanism and connecting means for connecting the control member with one of the movable arms, wherein the rest position and the first position of the control member correspond to the first position and the operative position of the two movable arms respectively, wherein said control member comprises two levers which are rotatable on the axis of the platen roller and an elastic coupling connecting said two levers, wherein the first lever is movable between the rest position and the operative position and the second lever is connected through the connecting means to one of the two movable arms, wherein the first lever is capable of operating the two movable arms for movement thereof by means of the second lever and the elastic coupling, and wherein the first lever operates said switch member to activate the rotary movement of the platen roller when the two movable arms are in the second position.

5. A control apparatus according to claim 4, wherein the cyclic actuating mechanism is operable to move the pressure rollers from the second position to the first position after a rotary movement of the platen roller for moving a sheet of paper from a position of introduction to the platen roller to a referenced position in which the upper edge of the sheet of paper is above a printing line of the machine and wherein the pressure rollers engage the sheet of paper in a region adjacent its upper edge.

6. Apparatus according to claim 4, further comprising a return spring for the driven gear capable of rotating the driven gear into a position at maximum spacing from the drive gear in the condition of disengagement between the drive gear and the driven gear.

* * * * *